US007224817B2

(12) United States Patent
Kosuda

(10) Patent No.: US 7,224,817 B2
(45) Date of Patent: May 29, 2007

(54) LOUDSPEAKER

(75) Inventor: Kazuyuki Kosuda, Mie (JP)

(73) Assignee: ONKYO Corporation, Neyagawa (JP)

( * ) Notice: Subject to any disclaimer, the term of this patent is extended or adjusted under 35 U.S.C. 154(b) by 157 days.

(21) Appl. No.: 10/424,436

(22) Filed: Apr. 28, 2003

(65) Prior Publication Data

US 2003/0215109 A1 Nov. 20, 2003

(30) Foreign Application Priority Data

May 16, 2002 (JP) ..... 2002-141291

(51) Int. Cl.
*H04R 25/00* (2006.01)

(52) U.S. Cl. ..... 381/412; 381/413; 381/420

(58) Field of Classification Search ..... 381/412, 381/414, 420–422, 419, 396, 400–403, 432, 381/413, 160, 395, 397, 405, 407, 409, 411, 381/348, 352–354, 416, 430, 423, 424; 181/160, 181/129, 148, 199, 161; 29/594, 609.1; 310/13, 310/14, 15, 23; 335/222–226, 281, 306, 335/302, 296

See application file for complete search history.

(56) References Cited

U.S. PATENT DOCUMENTS

| | | | | |
|---|---|---|---|---|
| 2,974,204 | A * | 3/1961 | Supitilov | 381/420 |
| 3,496,307 | A * | 2/1970 | Sotome | 381/420 |
| 4,742,887 | A * | 5/1988 | Yamagishi | 181/129 |
| 5,157,731 | A * | 10/1992 | Mitobe | 381/420 |
| 6,671,385 | B2 * | 12/2003 | Suzuki et al. | 381/412 |
| 6,711,269 | B2 * | 3/2004 | Kobayashi et al. | 381/117 |
| 6,721,430 | B2 * | 4/2004 | Wang | 381/334 |
| 6,740,590 | B1 * | 5/2004 | Yano et al. | 438/692 |
| 2002/0044671 | A1 * | 4/2002 | Shimomura et al. | 381/386 |

FOREIGN PATENT DOCUMENTS

| | | |
|---|---|---|
| JP | 55-150569 | 10/1980 |
| JP | 56-63194 | 5/1981 |
| JP | 57-4891 | 1/1982 |
| JP | 1-19518 | 2/1982 |
| JP | 63-25826 | 4/1982 |
| JP | 4-8598 | 1/1992 |
| JP | 05-168079 | 7/1993 |

* cited by examiner

*Primary Examiner*—Huyen Le
(74) *Attorney, Agent, or Firm*—Renner, Otto, Boisselle & Sklar, LLP

(57) ABSTRACT

A loudspeaker of the present invention includes a diaphragm; a voice coil for driving the diaphragm; and a magnetic circuit including a yoke, a magnet provided on the yoke, and an upper plate provided on the magnet, for producing a magnet field that is perpendicular to the voice coil. The upper plate has a surface configuration such that when reflecting sound waves created by the diaphragm, the upper plate diffuses the sound waves.

8 Claims, 5 Drawing Sheets

LOUDSPEAKER

BACKGROUND OF THE INVENTION

1. Field of the Invention

The present invention relates to a loudspeaker, and more particularly to a microspeaker having a good sound quality.

2. Description of the Related Art

Small loudspeakers (so-called "microspeakers") have been used for playing ringtones on mobile phones, for example. Typically, a microspeaker has a structure as illustrated in FIG. 5. Specifically, a microspeaker 50 includes a diaphragm 51, a voice coil 52 for driving the diaphragm 51, and a magnetic circuit 53 for producing a magnet field that is perpendicular to the voice coil 52. The periphery of the diaphragm 51 is supported by a wall portion of a frame 54. One end of the voice coil 52 is coupled to the diaphragm 51, and the other end thereof is located in the magnetic gap of the magnetic circuit 53. Note that although not shown, both ends of a coil section of the voice coil 52 are extracted to the side of the frame 54 and are connected to a sound input signal section through which a sound signal is input from the outside. The magnetic circuit 53 includes a yoke 56, and a magnet 57 provided on the yoke 56, and an upper plate 58 provided on the magnet 57, and produces a magnet field that is perpendicular to the voice coil 52.

In a microspeaker as described above, a resin film is used as the material of the diaphragm, and the distance between the diaphragm and the upper plate (pole piece) forming a part of the magnetic circuit is very small. As a result, distortion is exaggerated in a particular frequency range, whereby a satisfactory sound quality cannot be obtained.

In order to solve this problem, other microspeakers have been proposed, as illustrated in FIG. 6 and FIG. 7. In the loudspeaker of FIG. 6, a sound absorbing material 69 is provided between a diaphragm 61 and an upper plate 68. In the loudspeaker of FIG. 7, an upper plate 78 is shaped so as to conform to the shape of the diaphragm. These loudspeakers aim to suppress the reflection of sound waves between the diaphragm and the upper plate so as to improve the frequency characteristic and to reduce the harmonic distortion.

However, in either one of the loudspeakers of FIG. 6 and FIG. 7, there is little improvement on the audible sound quality, although the peak/dip in the frequency characteristic is reduced.

In view of the state of the art as described above, there is a strong demand for a small loudspeaker having a good sound quality.

SUMMARY OF THE INVENTION

It is an object of the present invention to provide a small loudspeaker having a good sound quality.

A loudspeaker of the present invention includes: a diaphragm; a voice coil for driving the diaphragm; and a magnetic circuit including a yoke, a magnet provided on the yoke, and an upper plate provided on the magnet, for producing a magnet field that is perpendicular to the voice coil, wherein the upper plate has a surface configuration such that when reflecting sound waves created by the diaphragm, the upper plate diffuses the sound waves.

In a preferred embodiment, the upper plate has a surface with irregularities.

In a preferred embodiment, a groove is formed in a vicinity of a periphery of the upper plate.

In a preferred embodiment, a depression is formed in a central portion of the upper plate.

In a preferred embodiment, a groove is formed in a vicinity of a periphery of the upper plate.

In a preferred embodiment, a thermosetting resin or a photocurable resin is provided in at least a portion of the depression.

In a preferred embodiment, the thermosetting resin is one selected from the group consisting of an epoxy resin, a polyurethane resin, a phenol resin, a urea resin, a melamine resin, and an alkyd resin.

In a preferred embodiment, the photocurable resin is one selected from the group consisting of an acrylic resin and an epoxy resin.

The function of the present invention will now be described.

According to the present invention, the upper plate has a surface configuration such that when reflecting sound waves created by the diaphragm, the upper plate diffuses the sound waves, whereby it is possible to provide a small loudspeaker having a good sound quality. More specifically, with such a surface configuration, it is possible to effectively diffuse sound waves created by the diaphragm without reducing the volume of the space under the diaphragm, whereby it is possible to reduce the distortion exaggerated in a particular frequency range. As a result, it is possible to obtain a small loudspeaker having a good audible sound quality in which the frequency characteristic is improved and the harmonic distortion is reduced.

In a preferred embodiment, the surface of the upper plate has surface irregularities because such a surface configuration can be formed easily and is cost-efficient. Moreover, in a preferred embodiment, a depression is formed in the central portion of the upper plate. In a small loudspeaker, sound waves are naturally localized to the central portion due to the shape of the loudspeaker. Therefore, it is possible to effectively improve the sound quality by diffusing the localized sound waves by the provision of the depression in the central portion.

Moreover, in a preferred embodiment, a thermosetting resin or a photocurable resin is provided in at least a portion of the depression. This is because by the provision of a curable resin, sound waves are diffused more randomly, and thus it is possible to more effectively improve the sound quality.

DETAILED DESCRIPTION OF THE PREFERRED EMBODIMENTS

Preferred embodiments of the present invention will now be described with reference to the accompanying drawings. Note however that the present invention is not limited to the particular embodiments set forth below.

Figure 1:
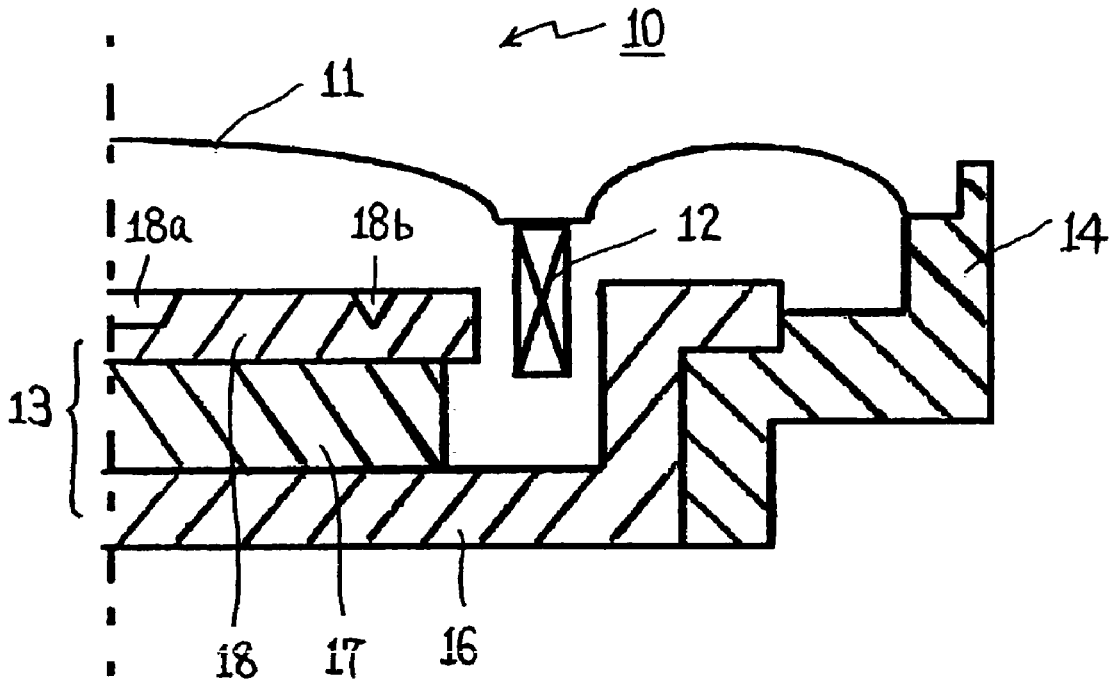
FIG. 1 is a schematic cross-sectional view illustrating a loudspeaker according to a preferred embodiment of the present invention.

FIG. 1 is a schematic cross-sectional view illustrating a loudspeaker 10 according to the preferred embodiment of the present invention. The loudspeaker 10 includes a diaphragm 11, a voice coil 12 for driving the diaphragm 11, and a magnetic circuit 13 for producing a magnet field that is perpendicular to the voice coil 12. The periphery of the diaphragm 11 is supported by a wall portion of a frame 14. One end of the voice coil 12 is coupled to the diaphragm 11, and the other end thereof is located in the magnetic gap of the magnetic circuit 13. Note that although not shown, both ends of a coil section of the voice coil 12 are extracted to the side of the frame 14 and are connected to a sound input signal section through which a sound signal is input from the outside. The magnetic circuit 13 includes a yoke 16, and a magnet 17 provided on the yoke 16, and an upper plate 18 provided on the magnet 17, and produces a magnet field that is perpendicular to the voice coil 12. The yoke 16 and the frame 14 may be formed as an integral member by insertion molding or may be coupled together by an adhesive. While the frame 14 may be made of any suitable material, the frame 14 is typically made of a resin.

The upper plate 18 has a diffusive surface configuration such that when reflecting sound waves created by the diaphragm 11, It diffuses the sound waves. The term "diffusive surface configuration" as used herein refers to a surface configuration such that sound waves arrive at different positions on the surface of an upper plate at different times and are reflected in different directions. In other words, a diffusive surface configuration is an uneven surface configuration. Typically, an uneven surface configuration may be obtained by providing surface irregularities or by using different materials. In view of the production cost, surface irregularities may be more preferred. Specific examples of an irregular surface include a surface with surface irregularities not having substantial depth such as a surface with a depression, a protrusion, a groove, a saw-toothed surface, and a rough surface such as that of sandpaper, or a surface with surface irregularities having substantial depth such as a surface with a through hole. It is preferred that a depression, a groove, a through hole, or the like, is provided, in which case the volume of the space under the diaphragm can be increased, thereby reducing the adverse influence of the air compression due to the vibration of the diaphragm on the diaphragm. Moreover, such surface irregularities can easily be formed at Intended positions, thereby allowing for an optimal design for the intended purpose.

Surface irregularities (e.g., depressions and/or grooves) may be formed at any suitable positions and in any suitable shape and number determined in view of the intended purpose. Preferably, a depression 18*a* is formed in a central portion of the upper plate 18, and a groove 18*b* is formed in a peripheral portion of the upper plate 18, as illustrated in FIG. 1. In a small loudspeaker, sound waves are naturally localized to the central portion due to the shape of the loudspeaker. Therefore, it is possible to effectively improve the sound quality by diffusing the localized sound waves by the depression 18*a*. In a typical product of the loudspeaker 10, the diameter ϕ of the diaphragm 11 may be 23 mm, the central depression 18*a* may have a conical shape with a depth of 0.3 mm, an upper diameter of 6 mm and a lower diameter of 3 mm, and the peripheral groove 18*b* may have a width of 1.0 mm and a depth of 0.3 mm.

Figure 2:
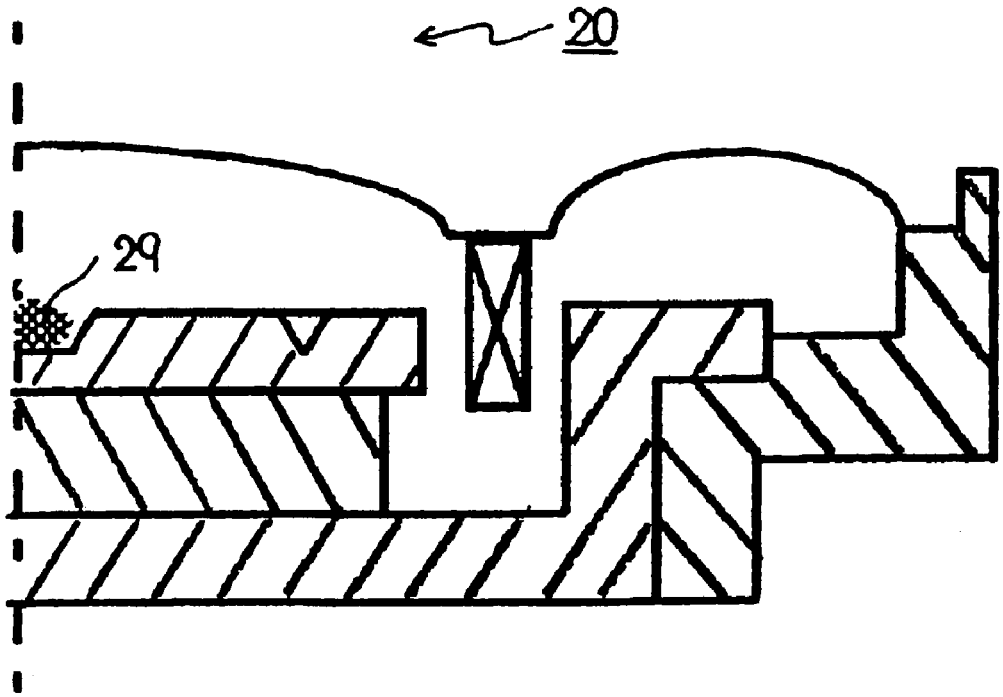
FIG. 2 is a schematic cross-sectional view illustrating a loudspeaker according to another embodiment of the present invention.

Preferably, a thermosetting or photocurable resin 29 is provided in at least a portion of the depression, as in a loudspeaker 20 illustrated in FIG. 2. In the illustrated example, the central depression is filled. Note that the structure illustrated in FIG. 2 is substantially the same as that illustrated in FIG. 1, except that the depression is filled with the thermosetting or photocurable resin 29, and thus will not be further described below. The thermosetting or photocurable resin 29 may be any suitable resin determined in view of the intended purpose. Typical examples of thermosetting resins include an epoxy resin, a polyurethane resin, a phenol resin, a urea resin, a melamine resin, an alkyd resin, and the like. Examples of photocurable resins include an acrylic resin, an epoxy resin, and the like. Resins that have a high rubber-like elasticity when cured are preferred because they can absorb and diffuse sound waves more randomly than hard resins. The rubber-like elasticity may be adjusted by adjusting the formulation of a thermosetting resin. More preferably, the curable resin is a photocurable resin (more specifically, a UV curable resin) because it can easily be applied to the most appropriate position and can easily be cured. The amount of curable resin to be applied may be any suitable amount, and in practice, an amount such that the depression is substantially filled is sufficient. If an excessive amount of curable resin is applied, the volume of the space under the diaphragm is reduced, whereby the air compression due to the vibration of the diaphragm may have an adverse influence on the diaphragm. In a case where the central depression has a conical shape with a depth of 0.3 mm, an upper diameter of 6 mm and a lower diameter of 3 mm, 0.001 mg of a curable resin is sufficient to substantially fill the depression.

The diaphragm 11 is typically made from a resin film. The resin may be any suitable resin determined in view of the intended purpose and application, and typical examples include polyetherimide (PEI), polyethylene terephthalate (PET), and polycarbonate (PC). Polyetherimide is particularly preferred because its adhesion, heat resistance and internal loss are suitable for environments under which the loudspeaker of the present invention is used. While the thickness of the diaphragm 11 may also be any suitable thickness determined in view of the intended purpose and application, it is typically 20 to 70 μm, and preferably 30 to 60 μm. With a thickness in such a range, it is possible to realize an optimal f0 value (300 to 500 Hz) and an optimal reproducing frequency range for a small loudspeaker. The voice coil 12 may be either a bobbin-less coil or a bobbin coil.

The loudspeaker of the present invention may suitably be used in small audio appliances, small information appliances (e.g., mobile phones), and the like.

Examples of the present invention will now be described.

EXAMPLE 1

A loudspeaker as illustrated in FIG. 1 was produced. In the loudspeaker, the diameter of the diaphragm was 23 mm, the central depression had a conical shape with a depth of 0.3 mm, an upper diameter of 6 mm and a lower diameter of 3 mm, and the peripheral groove had a width of 1.0 mm and a depth of 0.3 mm. The secondary distortion and the tertiary distortion of the loudspeaker are shown in FIG. 3 and FIG. 4, respectively.

COMPARATIVE EXAMPLE 1

Figure 4:
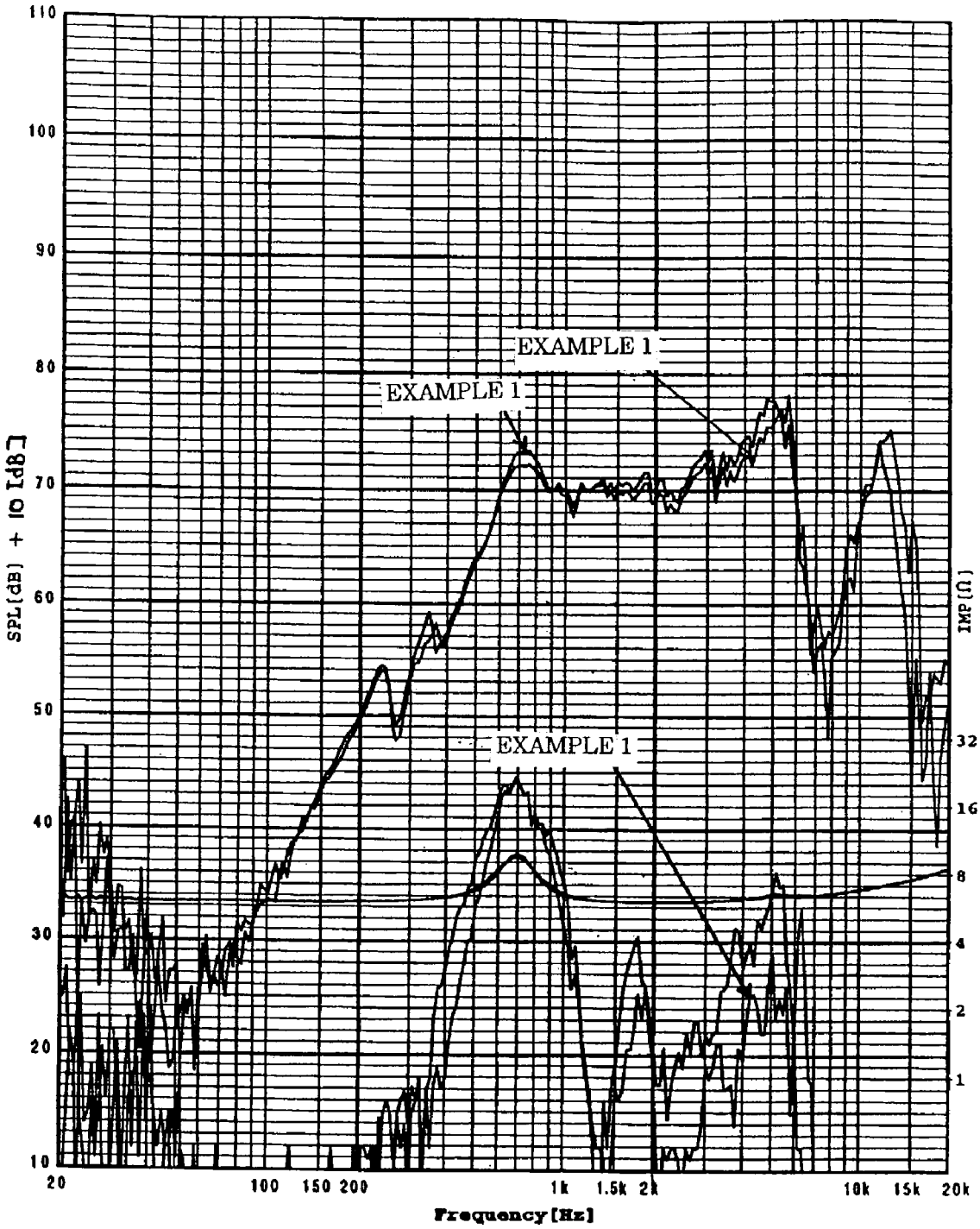
FIG. 4 is a graph illustrating a comparison between the frequency characteristic of a loudspeaker of the present invention and that of a conventional loudspeaker.
Figure 5:
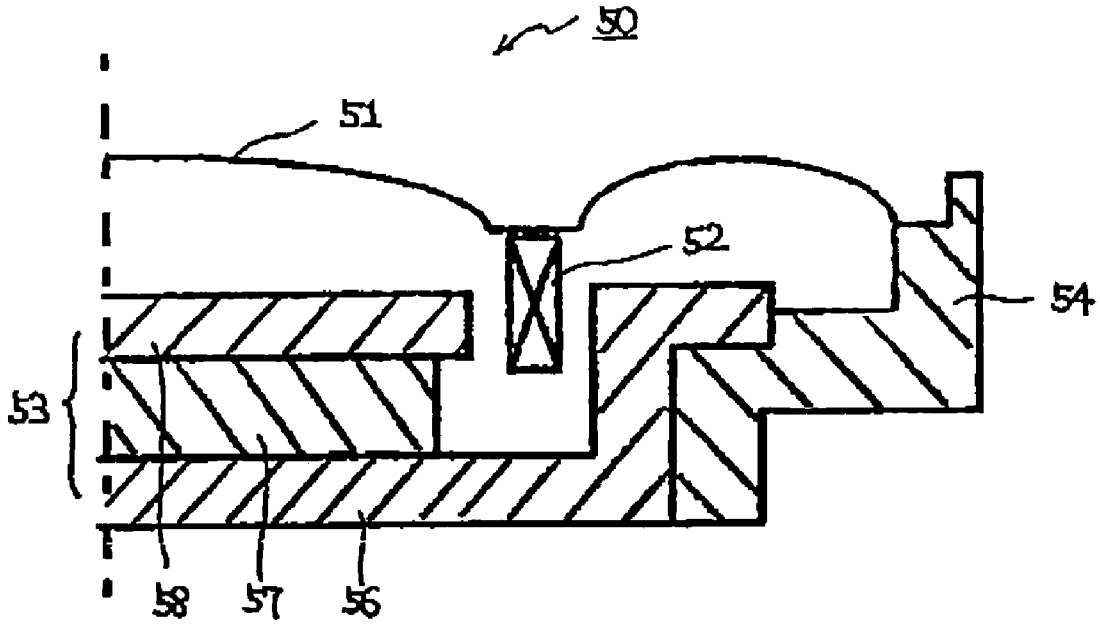
Fig. 5 RELATED ART
FIG. 5 is a schematic cross-sectional view illustrating a conventional loudspeaker.
Figure 6:
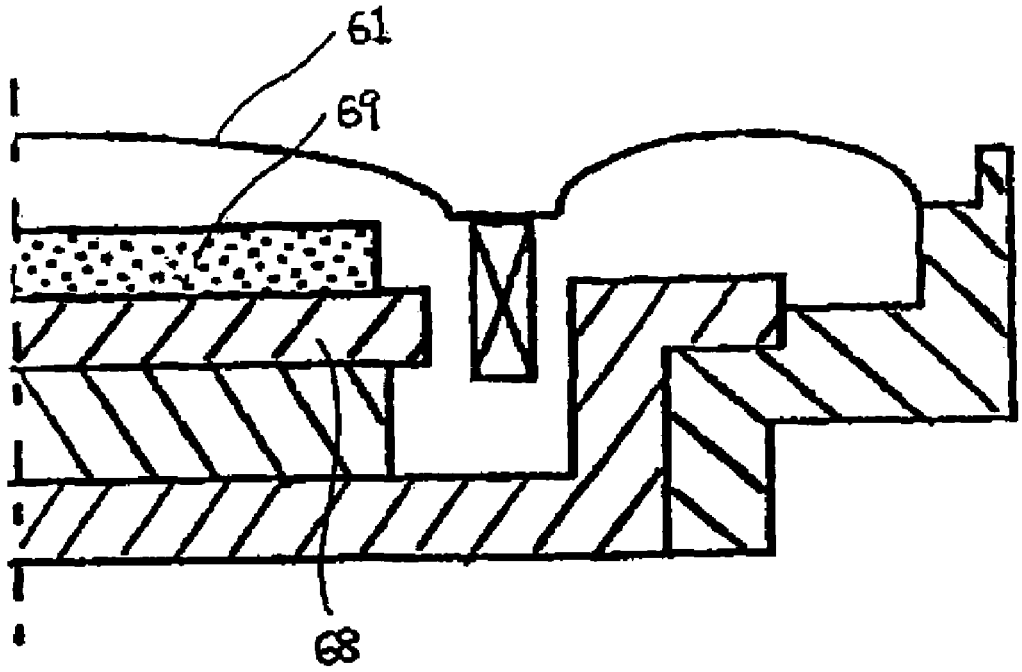
Fig. 6 RELATED ART
FIG. 6 is a schematic cross-sectional view illustrating a conventional loudspeaker.
Figure 7:
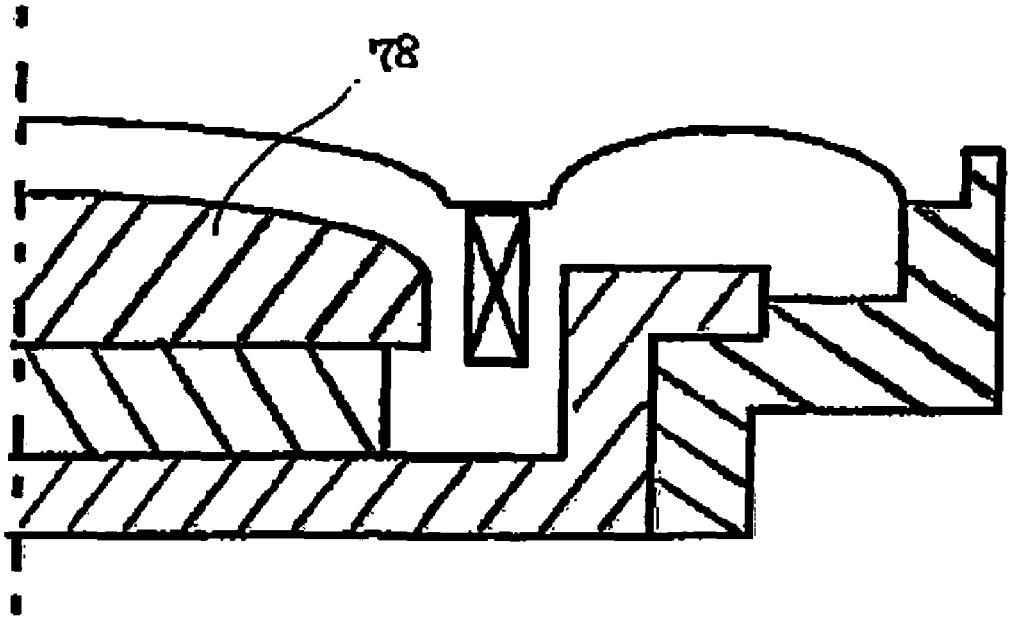
Fig. 7 RELATED ART
FIG. 7 is a schematic cross-sectional view illustrating a conventional loudspeaker.

A loudspeaker as illustrated in FIG. 5 was produced. In the loudspeaker, the diameter of the diaphragm was 23 mm. The secondary distortion and the tertiary distortion of the loudspeaker are shown in FIG. 3 and FIG. 4, respectively, together with those of the loudspeaker of Example 1.

Figure 3:
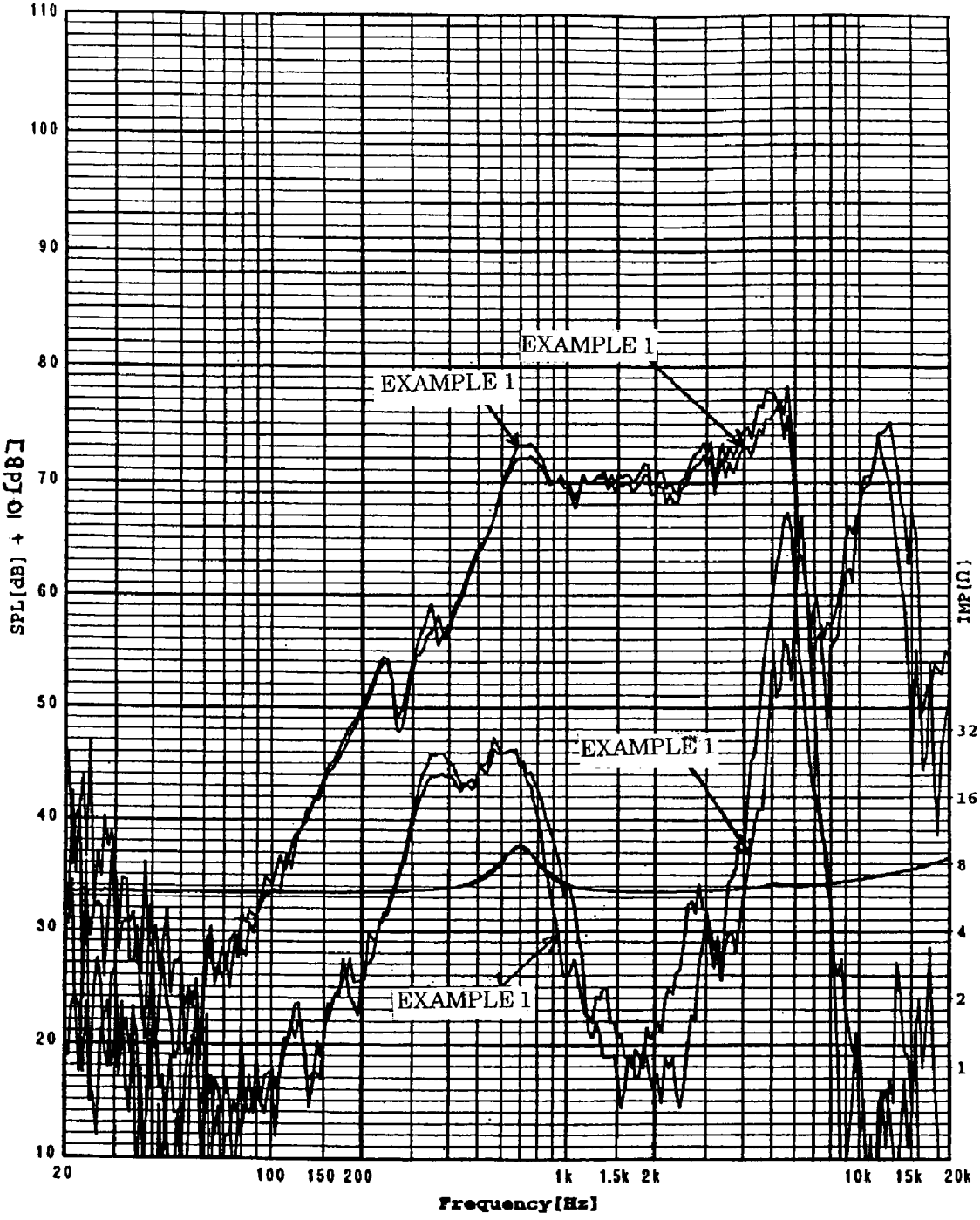
FIG. 3 is a graph illustrating a comparison between the frequency characteristic of a loudspeaker of the present invention and that of a conventional loudspeaker.

As is apparent from FIG. 3 and FIG. 4, the secondary distortion and the tertiary distortion are both improved significantly in the loudspeaker of the present invention, as compared with the loudspeaker of Comparative Example 1. It was also confirmed that the loudspeaker of the present invention had a better audible sound quality than the loudspeaker of Comparative Example 1.

As described above, according to the present invention, the surface of the upper plate is configured so that when reflecting sound waves created by the diaphragm, it diffuses the sound waves, whereby it is possible to provide a small loudspeaker having a good sound quality.

What is claimed is:

1. A loudspeaker, comprising:

a diaphragm;

a voice coil for driving the diaphragm; and a magnetic circuit including a yoke, a magnet provided on the yoke, and an upper plate provided on the magnet, for producing a magnet field that is perpendicular to the voice coil, wherein the surface of the upper plate circumscribed by the voice coil includes surface irregularities without substantial depth and which do not conform to the shape of the diaphragm such that when reflecting sound waves created by the diaphragm, the upper plate diffuses the sound waves, and the surface of the upper plate circumscribed by the voice coil does not include a through hole.

2. A loudspeaker according to claim 1, wherein a depression is formed in a central portion of the upper plate.

3. A loudspeaker according to claim 2, wherein a thermosetting resin or a photocurable resin is provided in at least a portion of the depression.

4. A loudspeaker according to claim 3, wherein the thermosetting resin is one selected from the group consisting of an epoxy resin, a polyurethane resin, a phenol resin, a urea resin, a melamine resin, and an alkyd resin.

5. A loudspeaker according to claim 3, wherein the photocurable resin is one selected from the group consisting of an acrylic resin and an epoxy resin.

6. A loudspeaker according to claim 2, wherein a groove is formed in a vicinity of a periphery of the upper plate.

7. A loudspeaker according to claim 1, wherein a groove is formed in a vicinity of a periphery of the upper plate.

8. A loudspeaker according to claim 1, wherein the surface irregularities comprise one or more depressions.

* * * * *